United States Patent [19]

Shini

[11] Patent Number: 4,794,039

[45] Date of Patent: Dec. 27, 1988

[54] MULTI-USABLE PRESSURE-SENSITIVE TRANSFER RECORDING MEDIUM

[75] Inventor: Masami Shini, Toyonaka, Japan

[73] Assignee: Fuji Kagakushi Kogyo Co., Ltd., Osaka, Japan

[21] Appl. No.: 92,920

[22] PCT Filed: Dec. 15, 1986

[86] PCT No.: PCT/JP86/00634

§ 371 Date: Aug. 14, 1987

§ 102(e) Date: Aug. 14, 1987

[87] PCT Pub. No.: WO87/03845

PCT Pub. Date: Jul. 2, 1987

[30] Foreign Application Priority Data

Dec. 17, 1985 [JP] Japan ..... 60-285179

[51] Int. Cl.[4] ..... B41M 5/025

[52] U.S. Cl. ..... 428/321.3; 428/206; 428/207; 428/330; 428/331; 428/476.3; 428/483; 428/520

[58] Field of Search ..... 428/195, 913, 914, 207, 428/329, 321.3, 206, 330, 331, 476.3, 483, 520

[56] References Cited

U.S. PATENT DOCUMENTS

| | | | |
|---|---|---|---|
| 4,018,162 | 4/1977 | Sharkey et al. | 101/473 |
| 4,069,179 | 1/1978 | Jones | 260/23 |
| 4,217,388 | 8/1980 | Scott et al. | 428/307 |
| 4,336,767 | 6/1982 | Wada et al. | 118/264 |
| 4,427,739 | 1/1984 | Kohle et al. | 428/323 |
| 4,515,489 | 5/1985 | Kohle et al. | 400/241.2 |
| 4,544,292 | 10/1985 | Kohle et al. | 400/241.2 |
| 4,612,243 | 9/1986 | Shimazaki et al. | 428/321.3 |
| 4,624,881 | 11/1986 | Shini | 428/207 |

FOREIGN PATENT DOCUMENTS

| | | | |
|---|---|---|---|
| 2815344 | 10/1979 | Fed. Rep. of Germany . | |
| 58-29694 | 2/1983 | Japan . | |
| 59-209190 | 11/1984 | Japan . | |
| 1217844 | 12/1970 | United Kingdom | 428/329 |

OTHER PUBLICATIONS

Patent Abstracts of Japan, vol. 7, No. 116 (M-216) [1261], May 20, 1983, and JP,A,58-36481.

Chemical Abstracts, vol. 93, No. 16, Oct. 20, 1980, Abstract No. 151780a.

Chemical Abstracts, vol. 92, No. 18, May 5, 1980, Abstract No. 1724846 and JP,A,54-152512.

Patent Abstracts of Japan, vol. 7, No. 193 (M-238) [1338], Aug. 24, 1983 and JP,A,58-92584.

*Primary Examiner*—John E. Kittle

*Assistant Examiner*—P. R. Schwartz

*Attorney, Agent, or Firm*—Armstrong, Nikaido, Marmelstein & Kubovcik

[57] ABSTRACT

A multi-usable pressure-sensitive transfer recording medium wherein a finely porous layer comprising minute porous particles and a binder material for bonding the porous particles to each other is provided on a surface of a foundation, and a liquid ink paste substantially incompatible with the binder material is contained in said finely porous layer. The recording medium is characterized in that said foundation is a plastic film, and said foundation and said finely porous layer are bonded to each other with an adhesive layer composed of a hydroxyl group-containing vinyl chloride-vinyl acetate copolymer cross-linked with an isocyanate compound, in order to make it possible to use the recording medium many times at low temperatures.

5 Claims, No Drawings

MULTI-USABLE PRESSURE-SENSITIVE TRANSFER RECORDING MEDIUM

TECHNICAL FIELD

The present invention relates to a multi-usable pressure-sensitive transfer recording medium. More particularly, it relates to a multi-usable pressure-sensitive transfer recording medium for use in over-strike or multi-strike printing on impact type typewriters or printers.

BACKGROUND ART

Such kind of multi-usable pressure-sensitive transfer recording medium which has been known heretofore includes a recording medium having a structure wherein a foundation of a plastic film and a finely porous layer in which a liquid ink paste is contained are bonded to each other with an adhesive layer composed of a vinyl chloride-vinyl acetate copolymer, as disclosed in Japanese unexamined patent publication No. 58-29694.

The above-mentioned pressure-sensitive recording medium had a drawback that the finely porous layer itself was liable to peel off from the film foundation and be transferred, whereby subsequent printing was made impossible, in particular, when printing was repeated at low temperatures, even though such adverse phonomenon took place either at ordinary temperatures or at high temperatures.

It is an object of the present invention to provide a multi-usable pressure-sensitive recording medium, the same position of which is capable of being used repeatedly for printing under a low-temperature circumstance as well as under an ordinary or high-temperature circumstance.

DISCLOSURE OF THE INVENTION

The present invention provides a multi-usable pressure-sensitive transfer recording medium wherein a finely porous layer comprising minute porous particles and a binder material for bonding the porous particles to each other is provided on a surface of a foundation, and a liquid ink paste substantially incompatible with the binder material is contained in said finely porous layer, characterized in that said foundation is a plastic film, and said foundation and said finely porous layer are bonded to each other with an adhesive layer comprising a hydroxyl group-containing copolymer comprising vinyl chloride and vinyl acetate, said copolymer being cross-linked with an isocyanate compound.

The recording medium of the present invention does not cause the problem that the porous layer peels off from the film foundation, even when the same position of the recording medium is used repeatedly for printing 20 or more times under a low-temperature circumstance, for example, at 0° C., as well as under an ordinary or high-temperature circumstance (for example, up to 45° C.). Thus a good printing can be effected by using the recording medium of the present invention.

Such effect does not alter adversely even after the recording medium of the present invention is allowed to stand either at −20° C. for a week or at 60° C. for a week.

The present invention is characterized by an improvement on the adhesive layer used for bonding the finely porous layer and the foundation to each other with respect to the above-mentioned recording medium.

The adhesive layer used in the present invention is formed from an adhesive prepared by cross-linking a hydroxyl group-containing vinylchloride-vinyl acetate copolymer with an isocyanate compound. This adhesive has an excellent adhesive property, in particular, at low temperatures.

The above-mentioned hydroxyl group-containing vinyl chloride-vinyl acetate copolymer contains the following recurring units:

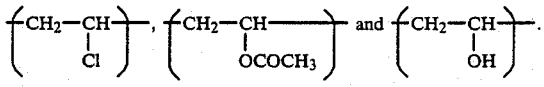

The copolymer is prepared by partially hydrolyzing a vinyl chloride-vinyl acetate copolymer.

A hydroxyl group-containing vinyl chloride-vinyl acetate copolymer containing 5 to 15% by weight of the vinyl alcohol unit, 85 to 93% by weight of the vinyl chloride unit and 0.5 to 3% by weight of the vinyl acetate unit is preferred. When the content of the vinyl alcohol unit is lower than 5% by weight, an adhesive strength between the finely porous layer and the foundation is lowered. When the content of the vinyl alcohol unit is higher than 15% by weight, the solubility of the copolymer to solvent is remarkably lowered and the pressure-transferability of the liquid ink paste is reduced. The average degree of polymerization of the copolymer is preferably from 300 to 700. When the average degree of polymerization is more than 700, the adhesive layer becomes so hard that the adhesive layer tends to be brittle at low temperatures. When the average degree of polymerization is less than 300, the adhesive strength is insufficient.

The isocyanate compound used in the present invention is a polyisocyanate, i.e. difunctional or tri- or polyfunctional isocyanate. Any usual polyisocyanates, for instance, those used in polyurethane adhesives, can be used without particular limitation. Typical examples of the polyisocyanate are tolylene diisocyanate, xylylene diisocyanate, diphenylmethane-4,4'-diisocyanate, triphenylmethane-p,p',p''-triisocyanate and hexamethylene diisocyanate. Urethane prepolymers which are products prepaed by reacting partially such polyisocyanate as mentioned above with a polyhydroxyl compound (for instance, trimethylolpropane and propylene glycol) and which have terminal NCO groups are also preferably employed as the isocyanate compound in the present invention. These isocyanate compounds may be used singly or as mixtures of two or more kinds thereof. When a mixture of isocyanate compounds which are different to each other in the number of NCO group is used, it is preferable to use a mixture having an average number of NCO group of not less than 1.8 per molecule.

The hydroxyl group-containing vinyl chloride-vinyl acetate copolymer is reacted with the isocyanate compound to cause crosslinking according to the following formula:

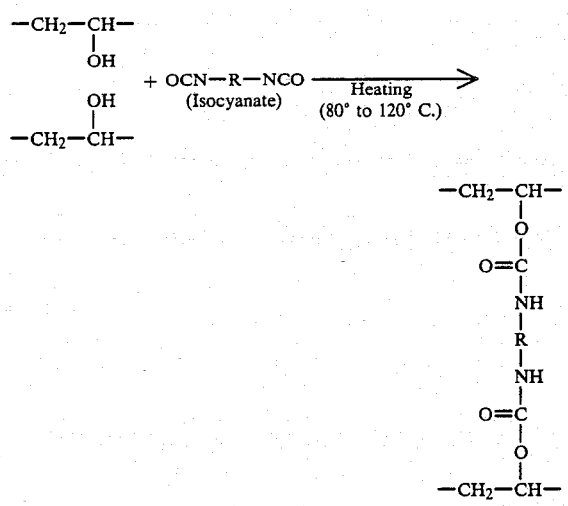

The amount of the isocyanate compound used is preferably from 1 to 6 parts (parts by weight, hereinafter the same) per 20 parts of the hydroxyl group-containing vinyl chloride-vinyl acetate copolymer. When the amount of the isocyanate compound is less than 1 part, the effect of improving the adhesiveness is insufficient. When the amount of the isocyanate compound is more than 6 parts, the pot life of the ink becomes short, so that the multi-printing ability is reduced to give a print image with a low density. The proportion of the isocyanate compound to the copolymer is from about 0.25 to about 1.50 in terms of molar ratio of NCO/OH.

Examples of the solvent used to prepare a solution of the adhesive are methyl ethyl ketone, methyl isobutyl ketone and acetone.

Other adhesives such as polyurethane adhesive, polyester adhesive and acrylic resin adhesive may be added to the above-mentioned adhesive.

The adhesive layer is formed by applying the adhesive to one side of a foundation in a coating amount of 1 to 4 g/m$^2$ (the value after being dried, hereinafter the same), preferably 2 to 3 g/m$^2$ by means of a coater. When the coating amount is less than 1 g/m$^2$, the adhesive strength is lowered. When the coating amount is more than 4 g/m$^2$, the retention of an ink is so high that the density of the print image is lowered.

Plastic films having a thickness of about 3 μm to about 50 μm, including polyester film, polypropylene film and polyamide film, are preferably used as the foundation.

Then, components for a liquid ink paste including coloring agent and viscosity-adjusting agent were mixed and the resultant is further mixed and blended with components for a finely porous layer including porous powder and binder material, and a volatile solvent. The thus obtained dispersion is applied onto the surface of the adhesive layer on the foundation, for instance, in a coating amount of 10 to 30 g/m$^2$, preferably 15 to 30 g/m$^2$ by means of a coater and dried, whereby a layer wherein a liquid ink paste composed of the coloring agent, viscosity-adjusting agent and other additive is contained in a finely porous layer composed on the porous powder and the binder material is formed on the adhesive layer, providing a pressure-sensitive transfer recording medium in accordance with the present invention.

Any coloring agent, such as dye and pigment, used for such kind of recording medium can be used as the above-mentioned coloring agent. However, the use of a solution of an oil-soluble dye in a liquid fatty acid in combination with a pigment is preferable, since the lowering in density of a print image with repetition of printing is noticeably reduced.

As the liquid fatty acid, there can be used oleic acid, isostearic acid and liquid fatty acids analogous thereto. These liquid fatty acids may be used singly or as admixtures of two or more kinds thereof. The liquid fatty acid is used preferably in an amount of 1 to 30% by weight on the basis of the total amount of the liquid ink paste.

Examples of the oil-soluble dye include, for instance, Nigrosine Base, Spirit Black, Special Black, Victoria Blue Base and Methyl Violet Base. These oil-soluble dyes may be used singly or as admixtures of two or more kinds thereof. The oil-soluble dye is used preferably in an amount of 1 to 10% by weight on the basis of the total amount of the liquid ink paste.

Examples of the pigment are carbon blacks such as Printex 25 (commercial name of a coloring carbon black made by DEGUSSA), Mogul L (commercial name of a coloring carbon black made by Cabot Corp.) and Raven 1255 (commercial name of a coloring carbon black made by Columbia Ribbon & Carbon Manufacturing Corp.); and black toner. These pigments may be used singly or as admixtures of two or more kinds thereof. The pigment is used preferably in an amount of 1 to 40% by weight, more preferably 20 to 40% by weight, on the basis of the total amount of the liquid ink paste.

As the above-mentioned viscosity-adjusting agent, there can be used any conventional viscosity-adjusting agent. Preferred examples of the viscosity-adjusting agent are vegetable oils such as rapeseed oil, soybean oil and castor oil; mineral oils such as vitrea oil and jet oil; coldproof plasticizers such as di(2-ethylhexyl)adipate (hereinafter referred to as "DOA"), di(2-ethylhexyl)-sebacate (hereinafter referred to as "DOS") and di(2-ethylhexyl)azelate (hereinafter referred to as "DOZ"); hydrocarbons such as lipolube oil; and oligomers of α-olefins. These viscosity-adjusting agents may be used singly or as admixtures of two or more kinds thereof. The viscosity-adjusting agent is used in such amount that the resulting liquid ink paste has preferably a viscosity of less than 4,000 cP (more preferably not more than 3,600 cP) and not less than 300 cP at 25° C. In particular, the viscosity-adjusting agent is used preferably in an amount of 20 to 50% by weight on the basis of the total amount of the liquid ink paste. When a solution wherein a weight ratio of the liquid fatty acid to the oil-soluble dye is from 20:1 to 2:1 is used as the coloring agent, a good repetitiveness of printing can be obtained even with a liquid ink paste having a viscosity of 2,000 to 10,000 cP.

Further, a wetting agent may be added to the liquid ink paste. Any conventional wetting agent can be used. Examples of the wetting agent are sorbitan fatty acid esters such as sorbitan monostearate, sorbitan monoisostearate and sorbitan monooleate, lecithin, and substances analogous to the foregoing. These wetting agents may be used singly or as admixtures of two or more kinds thereof. Preferably the wetting agent is used in an amount of 3 to 30% by weight (more especially 5 to 25% by weight) on the basis of the total amount of the liquid ink paste.

The above-mentioned porous particles are preferably those which have an average porosity of 50 to 97%, more especially 60 to 93% and an average particle size of 1 to 20 μm, including inorganic porous powders such as diatomaceous earth, zeolite, porous silica powder and activated carbon, and organic porous powders such as foamed polyurethane powder. Those porous powders may be used singly or as admixtures of two or more kinds thereof. The porous powder is used preferably in an amount of 1 to 4 parts, more especially 2 to 3 parts, per 10 parts of the liquid ink paste.

The binder material mentioned above is one or more resins which are incompatible with the components of the liquid ink paste and compatible with the volatile solvent mentioned below, and possess an adhesiveness to the porous particles mentioned below. Examples of the binder material are vinyl chloride-vinyl acetate copolymer, polyester resin, cellulose acetate butyrate, and the like. The amount of the binder material is preferably from 1 to 10 parts, more especially from 2 to 7 parts, per 10 parts of the liquid ink paste.

A vinyl chloride-vinyl acetate copolymer containing 4 to 7 parts of viny chloride per 5 parts of vinyl acetate is preferably used among these binder materials in order to obtain a clean print image with no unevenness. The preparation of a vinyl chloride-vinyl acetate copolymer having a vinyl chloride content of less than 4 parts per 5 parts of vinyl acetate is difficult. When a vinyl chloride-vinyl acetate copolymer having a vinyl chloride content of more than 7 parts per 5 parts of vinyl acetate is used, the resulting porous layer becomes so hard that the porous layer is easily broken. In view of the above, a vinyl chloride-vinyl acetate copolymer containing 4 to 7 parts of vinyl chloride per 5 parts of vinyl acetate, which is easily prepared, is used so as to form a finely porous layer which is hardly broken.

Further, when the average degree of polymerization of the vinyl chloride-vinyl acetate copolymer is less than 700, the copolymer is poor in heat resistance and there is a possibility that the liquid ink paste flows out from the porous layer when the ambient temperature is above 60° C. A copolymer having an average degree of polymerization higher than 950 is difficult in production. Accordingly, the average degree of polymerization of the copolymer is preferably from 700 to 950, particularly from 800 to 900.

As the volatile solvent, there are used one or more solvents such as methyl ethyl ketone (hereinafter referred to as "MEK"), acetone, methyl isobutyl ketone, toluene, and IP Solvent (commercial name of an isoparaffin hydrocarbon oil made by IDEMITSU KOSAN CO., LTD.).

BEST MODE FOR CARRYING OUT THE INVENTION

The present invention will be explained by referring to the Example.

EXAMPLE

Four kinds of adhesive Nos. 1 to 4 each having the formulation shown in Table 1 were prepared.

Each of these adhesives was applied to a polyethylene terephthalate film (thickness: 7 μm) by means of a blade coater so that the thickness after being dried was 2 g/m$^2$, and dried for one minute in a drying apparatus kept at 90° C. to cause a cross-linking reaction.

Thereafter, on the thus formed adhesive layer was formed an ink-containing porous layer with a thickness of 7 μm after being dried by using, in combination, 8 kinds of liquid ink paste Nos. 1 to 8 shown in Table 2 with 15 kinds of finely porous layer composition Nos. 1 to 15 shown in Table 3, thereby providing a transfer recording medium.

With respect to each of the thus obtained recording media, a test for evaluating a repetitiveness of printing was carried out under a circumstance of 0° C. by using an electronic typewriter AP-520 made by Canon Inc. As a result, even when the recording medium was struck at the same position 20 or more times, the peeling of the finely porous layer from the foundation did not occur with all recording media, and the obtained print image had a density sufficient to read it.

TABLE 1

| Adhesive | Hydroxyl group-containing vinyl chloride-vinyl acetate copolymer | | Isocyanate | | Other additive | | MEK (solvent) |
|---|---|---|---|---|---|---|---|
| No. | Kind | % by weight | Kind | % by weight | Kind | % by weight | % by weight |
| 1 | MPR-TA5C | 15 | Coronate HL | 7 | — | — | 78 |
| 2 | MPR-TA5C | 15 | Coronate HL | 1 | — | — | 84 |
| 3 | MPR-TA | 15 | Coronate L | 5 | — | — | 80 |
| 4 | MPR-TA5C | 12 | Coronate HL | 3 | Nippollan 2301 | 3 | 82 |

[Note]MPR-TA5C: commercial name of a hydroxyl group-containing vinyl chloride-vinyl acetate copolymer made by Nisshin Kagaku Kogyo Kabushiki Kaisha, which copolymer contains 87.3% by weight of vinyl chloride unit, 1.2% by weight of vinyl acetate unit and 11.5% by weight of vinyl alcohol unit, and has an average degree of polymerization of 340.

MPR-TA: commercial name of a hydroxyl group- containing vinyl chloride-vinyl acetate copolymer made by Nisshin Kagaku Kogyo Kabushiki Kaisha, which copolymer contains 91.9% by weight of vinyl chloride unit, 2.5% by weight of vinyl acetate unit and 5.6% by weight of vinyl alcohol unit, and has an average degree of polymerization of 440.

Coronate HL: commercial name of a polyisocyanate for use in a non-yellowing paint made by Nippon Poriuretan Kogyo Kabushiki Kaisha (solid content: 74 to 76% by weight; NCO content: 12.3 to 13.3% by weight).

Coronate L: commercial name of a polyisocyanate for use in a room temperature curable paint made by Nippon Poriuretan Kogyo Kabushiki Kaisha (ethyl acetate solution of a polyisocyanate prepared by reacting 3 moles of tolylene diisocyanate with 1 moleof trimethylolpropane, solid content: 74 to 76% by weight, NCO content: 12.7 to 13.7% by weight)

Nippollan 2301: commercial name of a polyurethane adhesive made by Nippon Poriuretan Kogyo Kabushiki Kaisha

TABLE 2

| Liquid ink paste No. | Coloring agent Kind | Coloring agent Amount (part) | Wetting agent Kind | Wetting agent Amount (part) | Viscosity-adjusting agent Kind | Viscosity-adjusting agent Amount (part) | Viscosity at 25° C. (cP) |
|---|---|---|---|---|---|---|---|
| 1 | Solution of 2 parts of Nigrosine Base EX in 4 parts of oleic acid | 6 | Sorbitan mono-stearate | 1 | DOZ | 9 | 400 |
| | Carbon black | 4 | | | | | |
| 2 | Solution of 2 parts of Nigrosine Base EX in 4 parts of oleic acid | 6 | Sorbitan mono-oleate | 4 | DOA | 5 | 1,000 |
| | Black toner | 5 | | | | | |
| 3 | Solution of 1 part of Nigrosine Base EX and 1 part of Special Black EB in 8 parts of iso-stearic acid | 10 | Sorbitan monoiso-stearate | 6 | DOZ | 4 | 2,000 |
| | | | | | Rapeseed oil | 6 | |
| | | | | | Vitrea oil | 3 | |
| | Black toner | 8 | | | | | |
| | Carbon black | 4 | | | | | |
| 4 | Solution of 1 part of Nigrosine Base EX in 3 parts of isostearic acid | 4 | Lecithin | 3 | DOS | 2 | 2,000 |
| | | | | | Rapeseed oil | 6 | |
| | | | | | Lipolube oil | 1 | |
| | Carbon black | 3 | | | | | |
| | Black toner | 5 | | | | | |
| 5 | Alkali Blue toner | 2 | — | — | Rapeseed oil | 5 | Semi-solid |
| | Carbon Black | 4 | | | | | |
| | | | | | Lanolin | 5 | |
| 6 | Alkali Blue toner | 1 | — | — | Hydrophilic petrolatum | 12 | 10,000 |
| | Carbon Black | 4 | | | | | |
| 7 | Isostearic acid | 4 | Lecithin | 1 | Rapeseed oil | 6 | 6,200 |
| | Nigrosine Base EX | 1 | | | | | |
| | Black toner | 5 | | | DOZ | 3 | |
| | Raven 1255 | 3 | | | Lipolube oil | 1 | |
| 8 | Isostearic acid | 20 | Sorbitan monoiso-stearate | 1 | DOZ | 5 | 8,500 |
| | Nigrosine Base EX | 1 | | | | | |
| | Special Black EB | 1 | | | | | |
| | Black toner | 4 | | | | | |
| | Raven 1255 | 4 | | | | | |

TABLE 3

| Finely porous layer No. | Porous powder Kind | Porous powder Amount (part) | Binder material Vinyl chloride-vinyl acetate copolymer: Vinyl chloride/vinyl acetate (weight ratio) | Average degree of poly-merization | Amount (part) |
|---|---|---|---|---|---|
| 1 | Diatomaceous earth | 2 | 4/5 | 760 | 2 |
| 2 | Diatomaceous earth | 2 | 5/5 | 780 | 2 |
| 3 | Diatomaceous earth | 2 | 6/5 | 830 | 2 |
| 4 | Diatomaceous earth | 2 | 7/5 | 930 | 2 |
| 5 | Whiton SB | 2 | 4/5 | 760 | 5 |
| 6 | Whiton SB | 2 | 5/5 | 780 | 7 |
| 7 | Whiton SB | 2 | 6/5 | 830 | 5 |
| 8 | Whiton SB | 2 | 7/5 | 930 | 5 |
| 9 | Silica 300 | 1 | 4/5 | 760 | 5 |
| 10 | Silica 300 | 1 | 5/5 | 780 | 5 |
| 11 | Silica 300 | 1 | 6/5 | 830 | 6 |
| 12 | Silica 300 | 1 | 7/5 | 930 | 5 |
| 13 | Diatomaceous earth | 2 | 10/5 | 420 | 2 |
| 14 | Whiton SB | 2 | 10/5 | 420 | 5 |
| 15 | Silica 300 | 1 | 10/5 | 420 | 5 |

[Note]*The parts in Table 3 mean the number of part per 10 parts of the liquid ink paste shown in Table 2.
*Diatomaceous earth: average particle size: 7 μm, average porosity: about 75%
*Whiton SB: commercial name of calcium carbonate made by Shiraishi Calcium Kabushiki Kaisha
*Silica 300: commercial name of porous silica powder made by Nippon Aerosil Kabushiki Kaisha The multi-usable pressure-sensitive transfer recording medium of the present invention exhibits an effect that it can give a print image having a density sufficient to read it, even when the same position is struck repeatedly for printing under a low-temperature circumstance.

I claim:

1. In a multi-usable pressure-sensitive transfer recording medium wherein a finely porous layer comprising minute porous particles and a binder material for bonding the porous particles to each other is provided on a surface of a foundation, and a liquid ink paste substantially incompatible with the binder material is contained in said finely porous layer, the improvement in which said binder is a copolymer containing 4 to 7 parts by weight of vinyl chloride per 5 parts by weight of vinyl acetate, said foundation is a plastic film, and said foundation and said finely porous layer are bonded to each other with an adhesive layer comprising a hydroxyl group-containing copolymer comprising vinyl chloride and vinyl acetate, said copolymer being cross-linked with an isocyanate compound in an amount of 1 to 6 parts by weight of the isocyanate compound per 20 parts by weight of said hydroxyl-group containing copolymer.

2. The recording medium of claim 1, wherein said hydroxyl group-containing copolymer comprising vinyl chloride and vinyl acetate comprises a vinyl alcohol unit, a vinyl chloride unit and a vinyl acetate unit.

3. The recording medium of claim 2, wherein said copolymer comprises 5 to 15% by weight of the vinyl alcohol, 85 to 93% by weight of the vinyl chloride unit and 0.5 to 3% by weight of the vinyl acetate unit.

4. The recording medium of claim 1, wherein said plastic film is at least one of a polyester film and a polyamide film.

5. The recording medium of claim 1, wherein said finely porous layer comprises a porous powder selected from the group consisting diatomaceous earth, calcium carbonate and porous silica powder.

* * * * *